US009725974B2

(12) United States Patent
Lovorn

(10) Patent No.: US 9,725,974 B2
(45) Date of Patent: Aug. 8, 2017

(54) USE OF DOWNHOLE PRESSURE MEASUREMENTS WHILE DRILLING TO DETECT AND MITIGATE INFLUXES

(71) Applicant: HALLIBURTON ENERGY SERVICES, INC., Houston, TX (US)

(72) Inventor: James R. Lovorn, Tomball, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 794 days.

(21) Appl. No.: 13/668,552

(22) Filed: Nov. 5, 2012

(65) Prior Publication Data

US 2013/0133948 A1 May 30, 2013

Related U.S. Application Data

(60) Provisional application No. 61/565,131, filed on Nov. 30, 2011.

(51) Int. Cl.
*E21B 21/08* (2006.01)

(52) U.S. Cl.
CPC ..... *E21B 21/08* (2013.01)

(58) Field of Classification Search
USPC ..... 175/24, 25, 38
See application file for complete search history.

(56) References Cited

U.S. PATENT DOCUMENTS 3,550,696 A * 12/1970 Kenneday ..... 175/25
4,733,232 A * 3/1988 Grosso ..... 367/82
4,867,254 A * 9/1989 Gavignet ..... 175/48
6,427,125 B1 7/2002 Gzara et al.
6,648,081 B2 11/2003 Fincher et al.
6,823,950 B2 11/2004 Von Eberstein et al.
6,904,981 B2 * 6/2005 van Riet ..... E21B 21/08 166/265
7,044,237 B2 5/2006 Leuchtenberg
7,158,886 B2 1/2007 Hou et al.
8,240,398 B2 8/2012 Lovorn et al.
2002/0108783 A1 8/2002 Elkins et al.
(Continued)

FOREIGN PATENT DOCUMENTS

CN 1688793 A 10/2005
CN 102071926 5/2011
(Continued)

OTHER PUBLICATIONS

Mike Reeves; "Intellipipe Moving Closer to Commercial Reality", Drilling Contractor article, dated Mar./Apr. 2004, 1 page.
(Continued)

*Primary Examiner* — Giovanna C Wright
*Assistant Examiner* — Ronald Runyan
(74) *Attorney, Agent, or Firm* — Chamberlain Hrdlicka

(57) ABSTRACT

A well drilling system can include a hydraulics model which determines a modeled fluid friction pressure and a calibration factor applied to the modeled friction pressure, and a flow control device which is automatically controlled in response to a change in the calibration factor. A well drilling method can include drilling a wellbore, a fluid circulating through the wellbore during the drilling, determining a calibration factor which is applied to a modeled fluid friction pressure, and controlling the drilling based at least in part on a change in the calibration factor.

28 Claims, 5 Drawing Sheets

(56) References Cited

U.S. PATENT DOCUMENTS

| | | | | |
|---|---|---|---|---|
| 2004/0253734 | A1 | 12/2004 | Firmin | |
| 2007/0151762 | A1* | 7/2007 | Reitsma | E21B 21/08 175/40 |
| 2007/0277975 | A1 | 12/2007 | Lovell et al. | |
| 2008/0210470 | A1 | 9/2008 | Stewart | |
| 2009/0312964 | A1 | 12/2009 | Najim Al-Khamis | |
| 2011/0139509 | A1* | 6/2011 | Pool et al. | 175/50 |
| 2011/0214882 | A1 | 9/2011 | Santos | |

FOREIGN PATENT DOCUMENTS

| | | | |
|---|---|---|---|
| EP | 1852718 | | 11/2007 |
| WO | 03071091 | A1 | 8/2003 |
| WO | 2008051978 | A1 | 5/2008 |
| WO | 2010101473 | | 9/2010 |

OTHER PUBLICATIONS

Scott McMillan, et al.; "Overcoming Drilling Challenges in Northwest China Using an Innovative MPD Technique", SPE/IADC 130317, dated Feb. 24-25, 2010, 12 pages.

International Search Report with Written Opinion issued Mar. 15, 2011 for PCT Patent Application No. PCT/US10/038586, 8 pages.

Specification and drawings for Serial No. PCT/US11/59743, filed Nov. 8, 2011, 56 pages.

* cited by examiner

USE OF DOWNHOLE PRESSURE MEASUREMENTS WHILE DRILLING TO DETECT AND MITIGATE INFLUXES

BACKGROUND

This disclosure relates generally to equipment utilized and operations performed in conjunction with drilling a subterranean well and, in one example described below, more particularly provides for use of downhole pressure measurements while drilling to detect and mitigate influxes.

A hydraulics model can be used to control a drilling operation, for example, in managed pressure, underbalanced, overbalanced or controlled pressure drilling. Typically, an objective is to maintain wellbore pressure at a desired value during the drilling operation. Unfortunately, an influx into a wellbore during drilling can disrupt normal drilling operations, and if left unchecked can lead to hazardous conditions.

Therefore, it will be appreciated that improvements are continually needed in the art of detecting and mitigating influxes during drilling operations.

DETAILED DESCRIPTION

Figure 1:
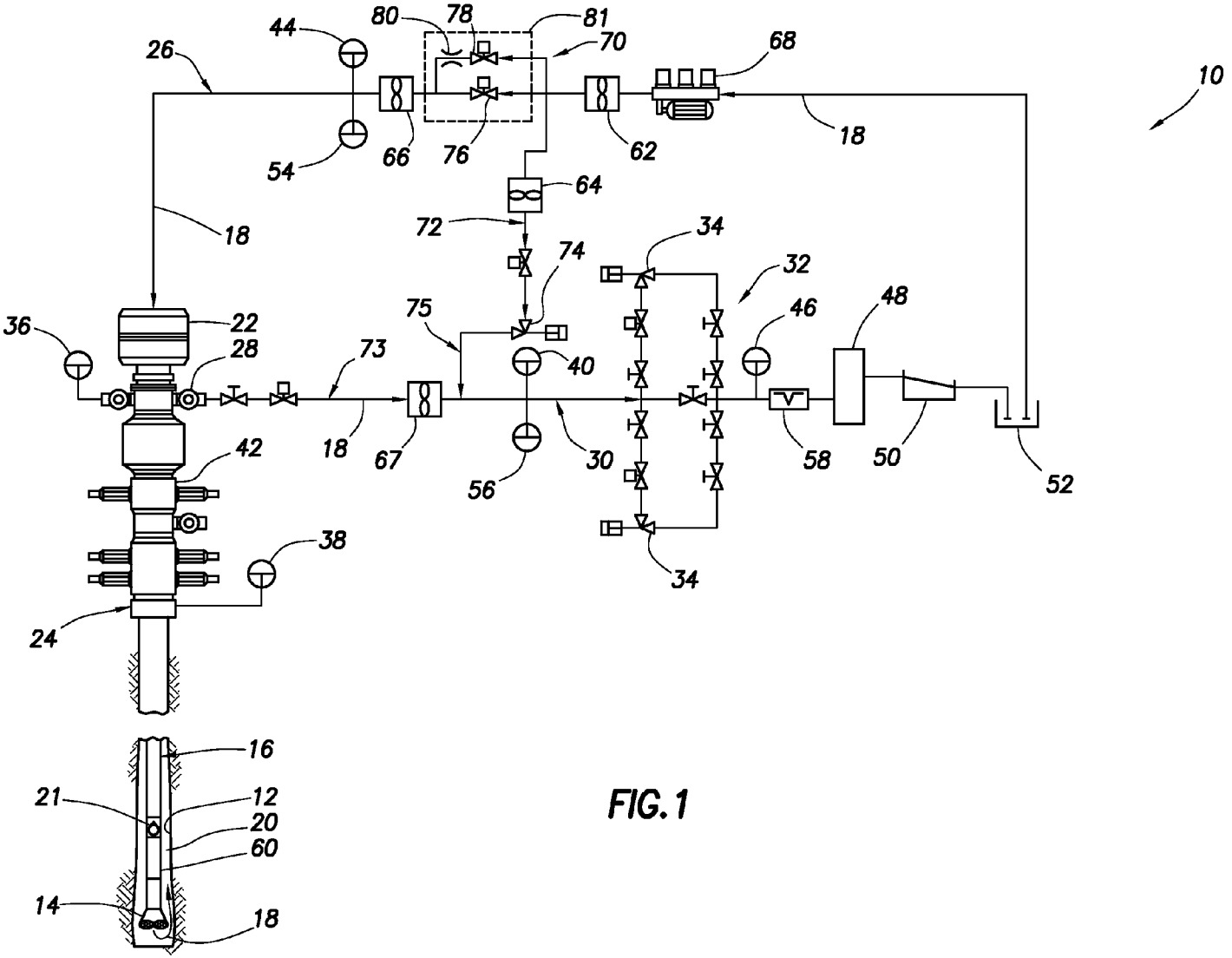
FIG. 1 is a representative partially cross-sectional view of a well drilling system and associated method which can embody principles of this disclosure.

Representatively illustrated in FIG. 1 is a well drilling system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a wellbore 12 is drilled by rotating a drill bit 14 on an end of a drill string 16. Drilling fluid 18, commonly known as mud, is circulated downward through the drill string 16, out the drill bit 14 and upward through an annulus 20 formed between the drill string and the wellbore 12, in order to cool the drill bit, lubricate the drill string, remove cuttings and provide a measure of bottom hole pressure control. A non-return valve 21 (typically a flapper-type check valve) prevents flow of the drilling fluid 18 upward through the drill string 16 (e.g., when connections are being made in the drill string).

Control of wellbore pressure is very important in managed pressure drilling, and in other types of drilling operations. Preferably, the wellbore pressure is precisely controlled to prevent excessive loss of fluid into the earth formation surrounding the wellbore 12, undesired fracturing of the formation, undesired influx of formation fluids into the wellbore, etc.

In typical managed pressure drilling, it is desired to maintain the wellbore pressure just slightly greater than a pore pressure of the formation penetrated by the wellbore, without exceeding a fracture pressure of the formation. This technique is especially useful in situations where the margin between pore pressure and fracture pressure is relatively small.

In typical underbalanced drilling, it is desired to maintain the wellbore pressure somewhat less than the pore pressure, thereby obtaining a controlled influx of fluid from the formation. In typical overbalanced drilling, it is desired to maintain the wellbore pressure somewhat greater than the pore pressure, thereby preventing (or at least mitigating) influx of fluid from the formation.

Nitrogen or another gas, or another lighter weight fluid, may be added to the drilling fluid 18 for pressure control. This technique is useful, for example, in underbalanced drilling operations.

In the system 10, additional control over the wellbore pressure is obtained by closing off the annulus 20 (e.g., isolating it from communication with the atmosphere and enabling the annulus to be pressurized at or near the surface) using a rotating control device 22 (RCD). The RCD 22 seals about the drill string 16 above a wellhead 24. Although not shown in FIG. 1, the drill string 16 would extend upwardly through the RCD 22 for connection to, for example, a rotary table (not shown), a standpipe line 26, kelley (not shown), a top drive and/or other conventional drilling equipment.

The drilling fluid 18 exits the wellhead 24 via a wing valve 28 in communication with the annulus 20 below the RCD 22. The fluid 18 then flows through mud return lines 30, 73 to a choke manifold 32, which includes redundant chokes 34 (only one of which might be used at a time). Backpressure is applied to the annulus 20 by variably restricting flow of the fluid 18 through the operative choke (s) 34.

In other examples, flow control devices other than chokes 34 may be used for applying backpressure to the annulus 20. For example, a valve or other type of flow control device can be used to restrict flow or divert flow, so that the backpressure applied to the annulus 20 is regulated.

In the FIG. 1 example, the greater the restriction to flow through the choke 34, the greater the backpressure applied to the annulus 20. Thus, downhole pressure (e.g., pressure at the bottom of the wellbore 12, pressure at a downhole casing shoe, pressure at a particular formation or zone, etc.) can be conveniently regulated by varying the backpressure applied to the annulus 20. A hydraulics model can be used, as described more fully below, to determine a pressure applied to the annulus 20 at or near the surface which will result in a desired downhole pressure, so that an operator (or an automated control system) can readily determine how to regulate the pressure applied to the annulus at or near the surface (which can be conveniently measured) in order to obtain the desired downhole pressure.

Pressure applied to the annulus 20 can be measured at or near the surface via a variety of pressure sensors 36, 38, 40, each of which is in communication with the annulus. Pressure sensor 36 senses pressure below the RCD 22, but above a blowout preventer (BOP) stack 42. Pressure sensor 38 senses pressure in the wellhead below the BOP stack 42. Pressure sensor 40 senses pressure in the mud return lines 30, 73 upstream of the choke manifold 32.

Another pressure sensor 44 senses pressure in the standpipe line 26. Yet another pressure sensor 46 senses pressure downstream of the choke manifold 32, but upstream of a separator 48, shaker 50 and mud pit 52. Additional sensors include temperature sensors 54, 56, Coriolis flowmeter 58, and flowmeters 62, 64, 66.

Not all of these sensors are necessary. For example, the system 10 could include only two of the three flowmeters 62, 64, 66. However, input from all available sensors can be useful to the hydraulics model in determining what the pressure applied to the annulus 20 should be during the drilling operation.

Other sensor types may be used, if desired. For example, it is not necessary for the flowmeter 58 to be a Coriolis flowmeter, since a turbine flowmeter, acoustic flowmeter, or another type of flowmeter could be used instead.

In addition, the drill string 16 may include its own sensors 60, for example, to directly measure downhole pressure. Such sensors 60 may be of the type known to those skilled in the art as pressure while drilling (PWD), measurement while drilling (MWD) and/or logging while drilling (LWD). These drill string sensor systems generally provide at least pressure measurement, and may also provide temperature measurement, detection of drill string characteristics (such as vibration, weight on bit, stick-slip, etc.), formation characteristics (such as resistivity, density, etc.) and/or other measurements. Various forms of wired or wireless telemetry (acoustic, pressure pulse, electromagnetic, etc.) may be used to transmit the downhole sensor measurements to the surface.

Additional sensors could be included in the system 10, if desired. For example, another flowmeter 67 could be used to measure the rate of flow of the fluid 18 exiting the wellhead 24, another Coriolis flowmeter (not shown) could be interconnected directly upstream or downstream of a rig mud pump 68, etc.

Fewer sensors could be included in the system 10, if desired. For example, the output of the rig mud pump 68 could be determined by counting pump strokes, instead of by using the flowmeter 62 or any other flowmeters.

Note that the separator 48 could be a 3 or 4 phase separator, or a mud gas separator (sometimes referred to as a "poor boy degasser"). However, the separator 48 is not necessarily used in the system 10.

The drilling fluid 18 is pumped through the standpipe line 26 and into the interior of the drill string 16 by the rig mud pump 68. The pump 68 receives the fluid 18 from the mud pit 52 and flows it via a standpipe manifold 70 to the standpipe 26. The fluid 18 then circulates downward through the drill string 16, upward through the annulus 20, through the mud return lines 30, 73, through the choke manifold 32, and then via the separator 48 and shaker 50 to the mud pit 52 for conditioning and recirculation.

Note that, in the system 10 as so far described above, the choke 34 cannot be used to control backpressure applied to the annulus 20 for control of the downhole pressure, unless the fluid 18 is flowing through the choke. In conventional overbalanced drilling operations, a lack of fluid 18 flow will occur, for example, whenever a connection is made in the drill string 16 (e.g., to add another length of drill pipe to the drill string as the wellbore 12 is drilled deeper), and the lack of circulation will require that downhole pressure be regulated solely by the density of the fluid 18.

In the system 10, however, flow of the fluid 18 through the choke 34 can be maintained, even though the fluid does not circulate through the drill string 16 and annulus 20, while a connection is being made in the drill string. Thus, pressure can still be applied to the annulus 20 by restricting flow of the fluid 18 through the choke 34, even though a separate backpressure pump may not be used.

When fluid 18 is not circulating through drill string 16 and annulus 20 (e.g., when a connection is made in the drill string), the fluid is flowed from the pump 68 to the choke manifold 32 via a bypass line 72, 75. Thus, the fluid 18 can bypass the standpipe line 26, drill string 16 and annulus 20, and can flow directly from the pump 68 to the mud return line 30, which remains in communication with the annulus 20. Restriction of this flow by the choke 34 will thereby cause pressure to be applied to the annulus 20 (for example, in typical managed pressure drilling).

As depicted in FIG. 1, both of the bypass line 75 and the mud return line 30 are in communication with the annulus 20 via a single line 73. However, the bypass line 75 and the mud return line 30 could instead be separately connected to the wellhead 24, for example, using an additional wing valve (e.g., below the RCD 22), in which case each of the lines 30, 75 would be directly in communication with the annulus 20.

Although this might require some additional piping at the rig site, the effect on the annulus pressure would be essentially the same as connecting the bypass line 75 and the mud return line 30 to the common line 73. Thus, it should be appreciated that various different configurations of the components of the system 10 may be used, and still remain within the scope of this disclosure.

Flow of the fluid 18 through the bypass line 72, 75 is regulated by a choke or other type of flow control device 74. Line 72 is upstream of the bypass flow control device 74, and line 75 is downstream of the bypass flow control device.

Flow of the fluid 18 through the standpipe line 26 is substantially controlled by a valve or other type of flow control device 76. Since the rate of flow of the fluid 18 through each of the standpipe and bypass lines 26, 72 is useful in determining how wellbore pressure is affected by these flows, the flowmeters 64, 66 are depicted in FIG. 1 as being interconnected in these lines.

However, the rate of flow through the standpipe line 26 could be determined even if only the flowmeters 62, 64 were used, and the rate of flow through the bypass line 72 could be determined even if only the flowmeters 62, 66 were used. Thus, it should be understood that it is not necessary for the system 10 to include all of the sensors depicted in FIG. 1 and described herein, and the system could instead include additional sensors, different combinations and/or types of sensors, etc.

In the FIG. 1 example, a bypass flow control device 78 and flow restrictor 80 may be used for filling the standpipe line 26 and drill string 16 after a connection is made in the drill string, and for equalizing pressure between the standpipe line and mud return lines 30, 73 prior to opening the flow control device 76. Otherwise, sudden opening of the flow control device 76 prior to the standpipe line 26 and drill string 16 being filled and pressurized with the fluid 18 could cause an undesirable pressure transient in the annulus 20 (e.g., due to flow to the choke manifold 32 temporarily being lost while the standpipe line and drill string fill with fluid, etc.).

By opening the standpipe bypass flow control device 78 after a connection is made, the fluid 18 is permitted to fill the standpipe line 26 and drill string 16 while a substantial majority of the fluid continues to flow through the bypass line 72, thereby enabling continued controlled application of pressure to the annulus 20. After the pressure in the standpipe line 26 has equalized with the pressure in the mud return lines 30, 73 and bypass line 75, the flow control device 76 can be opened, and then the flow control device 74 can be closed to slowly divert a greater proportion of the fluid 18 from the bypass line 72 to the standpipe line 26.

Before a connection is made in the drill string 16, a similar process can be performed, except in reverse, to gradually divert flow of the fluid 18 from the standpipe line 26 to the bypass line 72 in preparation for adding more drill pipe to the drill string 16. That is, the flow control device 74 can be gradually opened to slowly divert a greater proportion of the fluid 18 from the standpipe line 26 to the bypass line 72, and then the flow control device 76 can be closed.

Note that the flow control device 78 and flow restrictor 80 could be integrated into a single element (e.g., a flow control device having a flow restriction therein), and the flow control devices 76, 78 could be integrated into a single flow control device 81 (e.g., a single choke which can gradually open to slowly fill and pressurize the standpipe line 26 and drill string 16 after a drill pipe connection is made, and then open fully to allow maximum flow while drilling).

However, since typical conventional drilling rigs are equipped with the flow control device 76 in the form of a valve in the standpipe manifold 70, and use of the standpipe valve is incorporated into usual drilling practices, the individually operable flow control devices 76, 78 preserve the use of the flow control device 76. The flow control devices 76, 78 are at times referred to collectively below as though they are the single flow control device 81, but it should be understood that the flow control device 81 can include the individual flow control devices 76, 78.

Figure 2:
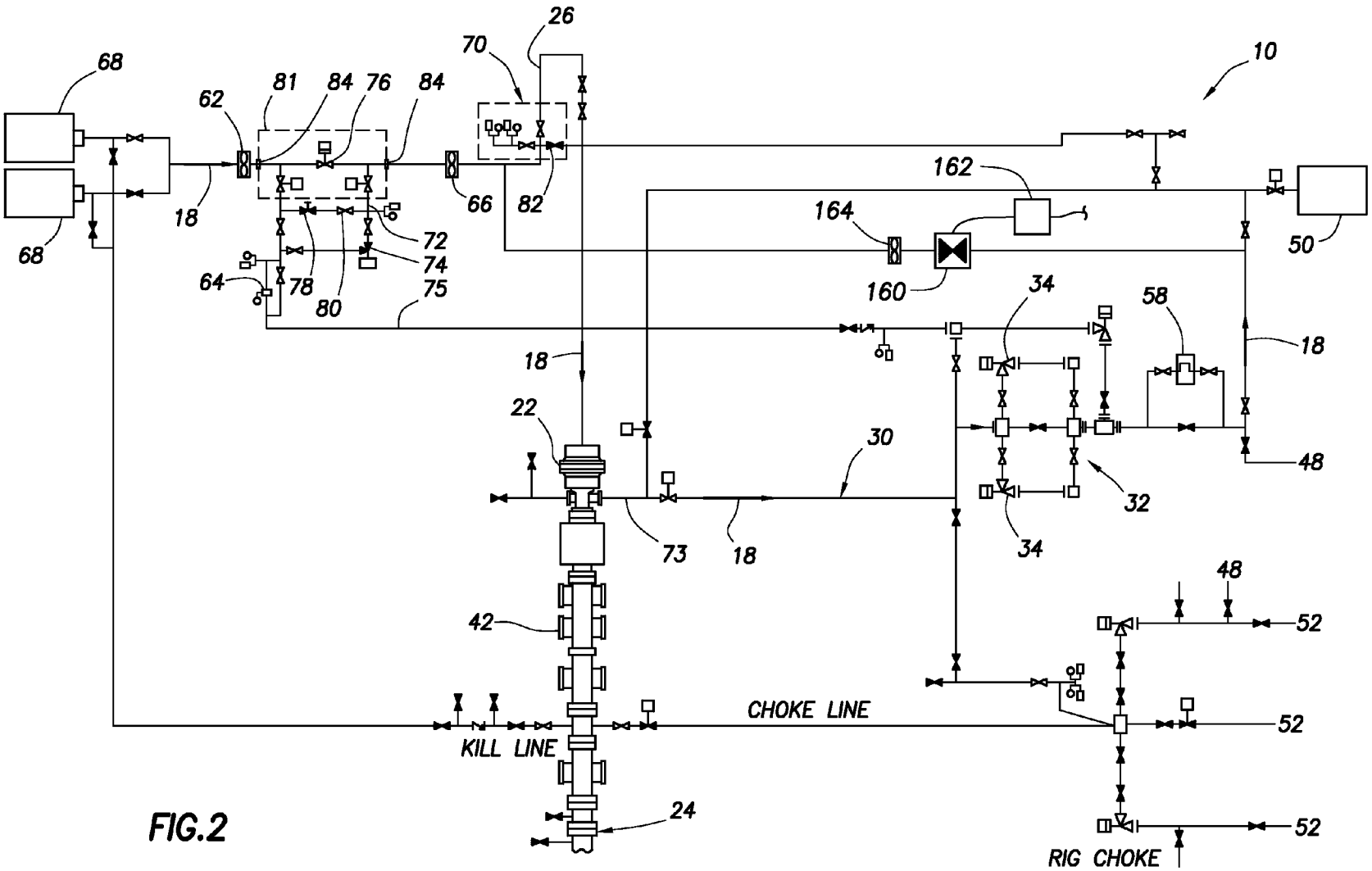
FIG. 2 is a representative schematic view of another example of the well drilling system and method.

Another example is representatively illustrated in FIG. 2. In this example, the flow control device 76 is connected upstream of the rig's standpipe manifold 70. This arrangement has certain benefits, such as, no modifications are needed to the rig's standpipe manifold 70 or the line between the manifold and the kelley, the rig's standpipe bleed valve 82 can be used to vent the standpipe 26 as in normal drilling operations (no need to change procedure by the rig's crew), etc.

The flow control device 76 can be interconnected between the rig pump 68 and the standpipe manifold 70 using, for example, quick connectors 84 (such as, hammer unions, etc.). This will allow the flow control device 76 to be conveniently adapted for interconnection in various rigs' pump lines.

Figure 3:
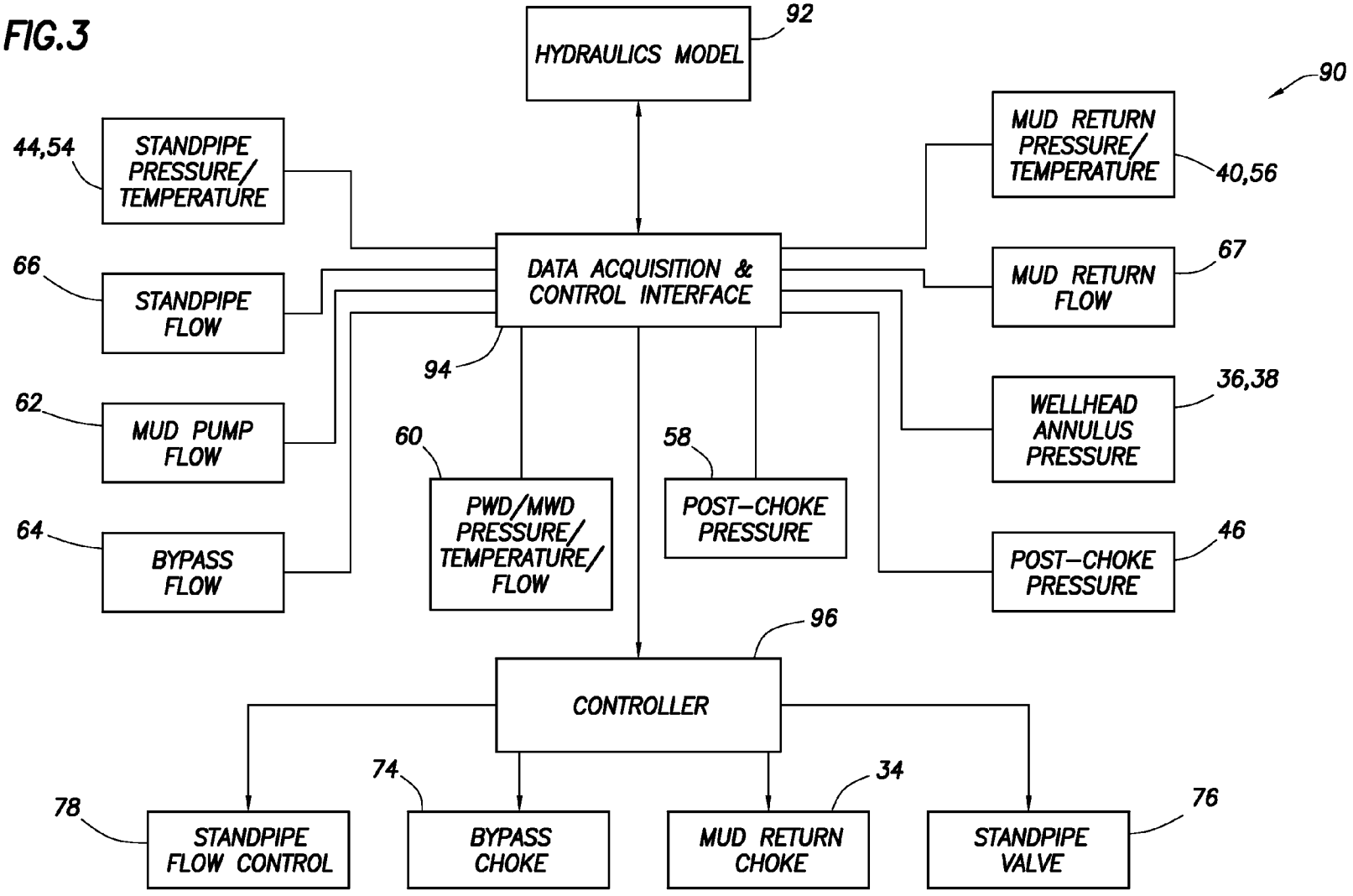
FIG. 3 is a representative schematic view of a pressure and flow control system which may be used with the system and method of FIGS. 1 & 2.

A specially adapted fully automated flow control device 76 (e.g., controlled automatically by the controller 96 depicted in FIG. 3) can be used for controlling flow through the standpipe line 26, instead of using the conventional standpipe valve in a rig's standpipe manifold 70. The entire flow control device 81 can be customized for use as described herein (e.g., for controlling flow through the standpipe line 26 in conjunction with diversion of fluid 18 between the standpipe line and the bypass line 72 to thereby control pressure in the annulus 20, etc.), rather than for conventional drilling purposes.

In the FIG. 2 example, a remotely controllable valve or other flow control device 160 is optionally used to divert flow of the fluid 18 from the standpipe line 26 to the mud return line 30 downstream of the choke manifold 32, in order to transmit signals, data, commands, etc. to downhole tools (such as the FIG. 1 bottom hole assembly including the sensors 60, other equipment, including mud motors, deflection devices, steering controls, etc.). The device 160 is controlled by a telemetry controller 162, which can encode information as a sequence of flow diversions detectable by the downhole tools (e.g., a certain decrease in flow through a downhole tool will result from a corresponding diversion of flow by the device 160 from the standpipe line 26 to the mud return line 30).

A suitable telemetry controller and a suitable remotely operable flow control device are provided in a GEOSPAN™ system marketed by Halliburton Energy Services, Inc. of Houston, Tex. USA. The telemetry controller 162 can be connected to an INSITE™ system or other acquisition and control interface 94 in the control system 90. However, other types of telemetry controllers and flow control devices may be used in keeping with the scope of this disclosure.

Note that each of the flow control devices 74, 76, 78 and chokes 34 are preferably remotely and automatically controllable to maintain a desired downhole pressure by maintaining a desired annulus pressure at or near the surface. However, any one or more of these flow control devices 74, 76, 78 and chokes 34 could be manually controlled, in keeping with the scope of this disclosure.

A pressure and flow control system 90 which may be used in conjunction with the system 10 and associated methods of FIGS. 1 & 2 is representatively illustrated in FIG. 3. The control system 90 is preferably fully automated, although some human intervention may be used, for example, to safeguard against improper operation, initiate certain routines, update parameters, etc.

The control system 90 includes a hydraulics model 92, a data acquisition and control interface 94 and a controller 96 (such as a programmable logic controller or PLC, a suitably programmed computer, etc.). Although these elements 92, 94, 96 are depicted separately in FIG. 3, any or all of them could be combined into a single element, or the functions of the elements could be separated into additional elements, other additional elements and/or functions could be provided, etc.

The hydraulics model 92 is used in the control system 90 to determine the desired annulus pressure at or near the surface to achieve a desired downhole pressure. Data such as well geometry, fluid properties and offset well information (such as geothermal gradient and pore pressure gradient, etc.) are utilized by the hydraulics model 92 in making this determination, as well as real-time sensor data acquired by the data acquisition and control interface 94.

Thus, there is a continual two-way transfer of data and information between the hydraulics model 92 and the data acquisition and control interface 94. It is important to appreciate that the data acquisition and control interface 94 operates to maintain a substantially continuous flow of real-time data from the sensors 44, 54, 66, 62, 64, 60, 58, 46, 36, 38, 40, 56, 67 to the hydraulics model 92, so that the hydraulics model has the information it needs to adapt to changing circumstances and to update the desired annulus pressure, and the hydraulics model operates to supply the data acquisition and control interface substantially continuously with a value for the desired annulus pressure.

A suitable hydraulics model for use as the hydraulics model 92 in the control system 90 is REAL TIME HYDRAULICS™ or GB SETPOINT™ marketed by Halliburton Energy Services, Inc. of Houston, Tex. USA. Another suitable hydraulics model is provided under the trade name IRIS™, and yet another is available from SINTEF of Trondheim, Norway. Any suitable hydraulics model may be used in the control system 90 in keeping with the principles of this disclosure.

A suitable data acquisition and control interface for use as the data acquisition and control interface 94 in the control system 90 are SENTRY™ and INSITE™ marketed by Halliburton Energy Services, Inc. Any suitable data acquisition and control interface may be used in the control system 90 in keeping with the principles of this disclosure.

The controller 96 operates to maintain a desired setpoint annulus pressure by controlling operation of the mud return choke 34 and other devices. When an updated desired annulus pressure is transmitted from the data acquisition and control interface 94 to the controller 96, the controller uses the desired annulus pressure as a setpoint and controls operation of the choke 34 in a manner (e.g., increasing or decreasing flow resistance through the choke as needed) to maintain the setpoint pressure in the annulus 20. The choke 34 can be closed more to increase flow resistance, or opened more to decrease flow resistance.

Maintenance of the setpoint pressure is accomplished by comparing the setpoint pressure to a measured annulus pressure (such as the pressure sensed by any of the sensors 36, 38, 40), and decreasing flow resistance through the choke 34 if the measured pressure is greater than the setpoint pressure, and increasing flow resistance through the choke if the measured pressure is less than the setpoint pressure. Of course, if the setpoint and measured pressures are the same, then no adjustment of the choke 34 is required. This process is preferably automated, so that no human intervention is required, although human intervention may be used, if desired.

The controller 96 may also be used to control operation of the standpipe flow control devices 76, 78 and the bypass flow control device 74. The controller 96 can, thus, be used to automate the processes of diverting flow of the fluid 18 from the standpipe line 26 to the bypass line 72 prior to making a connection in the drill string 16, then diverting flow from the bypass line to the standpipe line after the connection is made, and then resuming normal circulation of the fluid 18 for drilling. Again, no human intervention may be required in these automated processes, although human intervention may be used if desired, for example, to initiate each process in turn, to manually operate a component of the system, etc.

Data validation and prediction techniques may be used in the system 90 to guard against erroneous data being used, to ensure that determined values are in line with predicted values, etc. Suitable data validation and prediction techniques are described in International Application No. PCT/US11/59743, although other techniques may be used, if desired.

When drilling in an open circulation system, pressure-while-drilling (PWD) pressure measurement tools have been used to monitor bottom hole pressures, and have been used to detect wellbore events. With managed pressure drilling (MPD) and the use of chokes 34 or other types of flow control devices to maintain desired wellbore pressure, the use of PWD measurements to detect events has been greatly limited.

A calibration factor CF for adjusting a fluid friction pressure calculated by the hydraulics model 92 can be given by the following equation:

$$CF=(\text{PWD psi}-\text{WHP}-\text{Hydrostatic})/\text{model friction} \quad (1)$$

where PWD psi is the pressure measurement made by a PWD tool (such as sensor 60) interconnected in the drill string 16, WHP is annulus pressure as measured at or near the surface (e.g., at the wellhead 24), and Hydrostatic is the static wellbore pressure (e.g., without circulation through the drill string and annulus 20) at a location in the wellbore, due to a weight of a column of fluid 18 above the location. Hydrostatic is calculated, based on a measured density of the fluid 18 and a measured true vertical depth of the fluid column above the wellbore location.

The model friction is calculated in real-time by the hydraulics model 92. The calibration factor CF is applied to the model friction (CF*model friction) to calculate the actual friction pressure (Friction).

The numerator of the above equation (PWD psi−WHP−Hydrostatic) under normal managed pressure drilling conditions is a determination of the measured friction pressure in the wellbore 12, and is a real-time value (each of the terms in the numerator is available for use in the equation in real-time). PWD data transmission frequency may be several seconds to several minutes, and Equation (1) can be applied to calculate the calibration factor CF each time PWD data is received.

In normal circumstances, there should be very little difference between the modeled and the measured friction pressure (the denominator and numerator, respectively, in the above equation), so the CF should be approximately 1. If CF increases, this is an indicator that fluid friction in the wellbore 12 is increasing (e.g., more cuttings in the wellbore, partial collapse of the wellbore, etc.). If CF begins to decrease, this is an indication of decreasing fluid friction, which could be the result of gas lift (e.g., gas expanding in the annulus 20 as it flows upward to the surface, thereby reducing the effective density of the annulus fluid 18 column).

In managed pressure drilling (e.g., drilling with the annulus closed to the atmosphere at or near the surface, and with pressure in the annulus 20 being regulated to thereby regulate downhole pressure), one or more chokes 34 which restrict flow of the fluid 18 from the annulus may be controlled using the following equation:

$$\text{WHP}=\text{Desired}-\text{Friction}-\text{Hydrostatic} \quad (2)$$

where Desired is the desired pressure at any location in a wellbore (e.g., at a bottom or distal end of the wellbore, at a casing shoe, at an under-pressured zone penetrated by the wellbore, etc.), and Friction is the pressure due to fluid friction in the annulus 20 (Friction=CF*model friction, as discussed above).

The choke(s) 34 may be opened further (resulting in less restriction to flow) if the WHP is greater than that given by the above equation, and the choke(s) may be closed further (resulting in more restriction to flow) if the WHP is less than that given by the above equation. Use of appropriate values for the terms in Equation (2) for calculating the WHP is, therefore, very important for controlling operation of the choke(s) 34, or otherwise precisely controlling wellbore 12 pressure.

Figure 4:
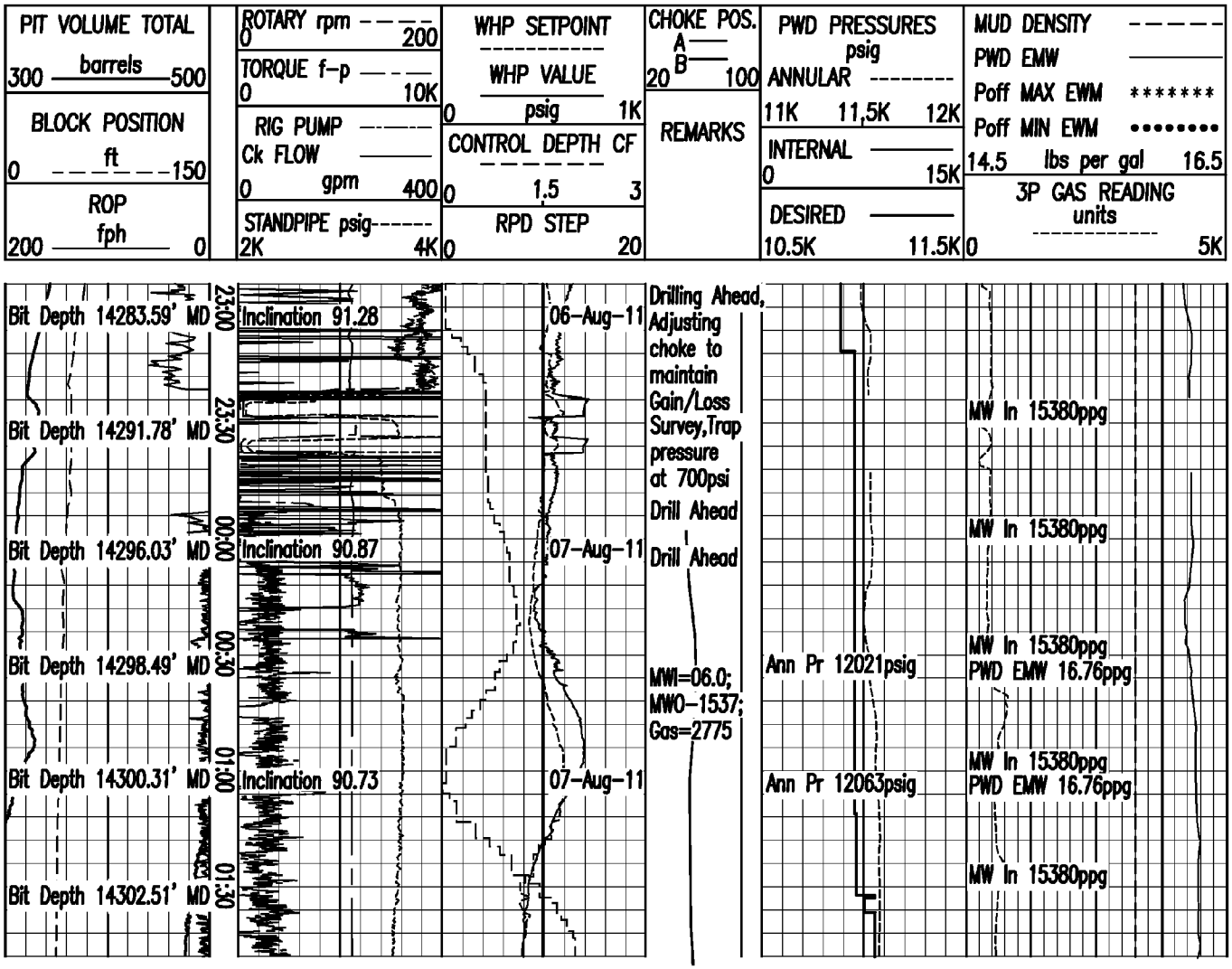
FIG. 4 is a representative drilling log, in which an influx event is recorded.

It has been discovered that, after an influx occurs in a situation where a PWD tool or other pressure sensor 60 is part of the drill string 16, the hydraulics model 92 will adjust the CF (e.g., applying Equation (1) above) to maintain a desired wellbore pressure (see the log example depicted in FIG. 4). When the control system 90 is controlling the wellbore 12 pressure with automation (e.g., the choke(s) 34 are automatically controlled to maintain the desired wellbore pressure) and with the hydraulics model 92 operating, the CF can decrease rapidly (e.g., as low as 0.001) when such an influx occurs.

Such a low CF is not correct, since with any circulating fluid 18 there has to be friction in the wellbore 12. The error in Equation 1 during an influx, then, is in the Hydrostatic term (e.g., in the static fluid density used to calculate the hydrostatic pressure). During an influx, as gas migrates up the annulus 20, and the influx fluid (e.g., gas condensate, etc.) transitions from a single phase to a multiphase fluid, the hydrostatic pressure in the annulus 20 will decrease.

To use PWD for kick detection and prevention in MPD operations, an identification of the kick (influx) could be through real-time monitoring, trend analysis applications, and/or neural net analysis, etc., of the hydraulics model 92 calculated calibration factor CF. Other techniques for identification of the influx from the characteristics of the CF (e.g., assessment of a slope, second order derivative, etc. of the CF) could be used, if desired. During the real-time analysis of the CF, if at some time a predetermined regression or aggression occurs, an alarm could be triggered, and the hydraulics model 92 could begin correcting the Hydrostatic term of the control algorithm to prevent any further influx.

The following is an algorithm which, applied as discussed more fully below, will prevent the influx from increasing:

$$\text{Adjusted MW}=\text{Prior MW}-((\text{Prior Friction}-\text{Observed Friction})/(0.052*\text{TVD})) \quad (3)$$

where Adjusted MW is an adjusted mud weight (fluid 18 density) for use in calculating the Hydrostatic term, Prior MW is a next previous calculated or measured fluid density, Prior Friction is a next previous modeled friction pressure, Observed Friction is a currently calculated friction pressure (e.g., using Equation 2), and TVD is true vertical depth. Note that the 0.052 term is for converting mud weight in pounds per gallon to pounds per square inch (when multiplied by TVD in feet). This conversion factor will change if other units are used.

Applied repeatedly, this Equation 3 will adjust the Hydrostatic term until the CF substantially equals 1. Once the influx is out of the annulus 20, the CF will begin to increase and, using the same equation, the Hydrostatic term will be appropriately adjusted.

As soon as the influx has been identified (e.g., using real-time monitoring, trend analysis applications, neural net analysis, etc.), Equation 3 can be repeatedly applied to gradually decrease the Hydrostatic term of Equation 1. In actual practice, this will result in a gradual decrease in the Hydrostatic term of Equation 1, until the CF term stabilizes and begins increasing again.

In the FIG. 4 example log, the calibration factor CF decreases to near zero when an influx into a wellbore occurs. Note that the decrease in the CF begins in advance of a significant increase in pit volume, and in advance of an increase in a 3 P gas reading. This (the influx and resulting CF decrease) is a situation which can be avoided using the principles described herein.

Note that the mud weight MW remains unchanged in the FIG. 4 log, even after the influx has occurred, the pit volume has increased, and increased gas has been detected at the surface. This lack of adjustment to the fluid density after the influx, with the consequent reduction in the calibration factor CF, is mitigated by use of the principles described herein.

Since the decrease in the calibration factor CF depicted in the FIG. 4 log precedes the pit volume increase and the increased gas reading at the surface, it will be appreciated that this CF decrease can serve as an early indicator of the influx occurring. Using the real-time monitoring, trend analysis applications, neural net analysis techniques, etc., mentioned above, such influx-indicating CF decreases can be readily identified, so that an operator can be alerted, remedial actions (such as use of Equation 3 above to modify the Hydrostatic term, etc.) can be taken, and further influxes can be prevented.

This approach to early kick (influx) detection and prevention is markedly different from prior approaches. Kick detection with MPD has generally been by monitoring choke adjustment and mass flow differences (mass flow out of the well minus mass flow into the well), which techniques have heretofore yielded mixed results.

When measurements made by a PWD tool (or other downhole pressure measurement device, such as, an MWD tool) are used in the manner described above, the calibration factor CF can be accurately determined, even if an influx results in a change in the fluid density. This will allow for enhanced wellbore pressure control, with the pressure measurement tool (PWD, MWD, etc.) in the wellbore 12.

Figure 5:
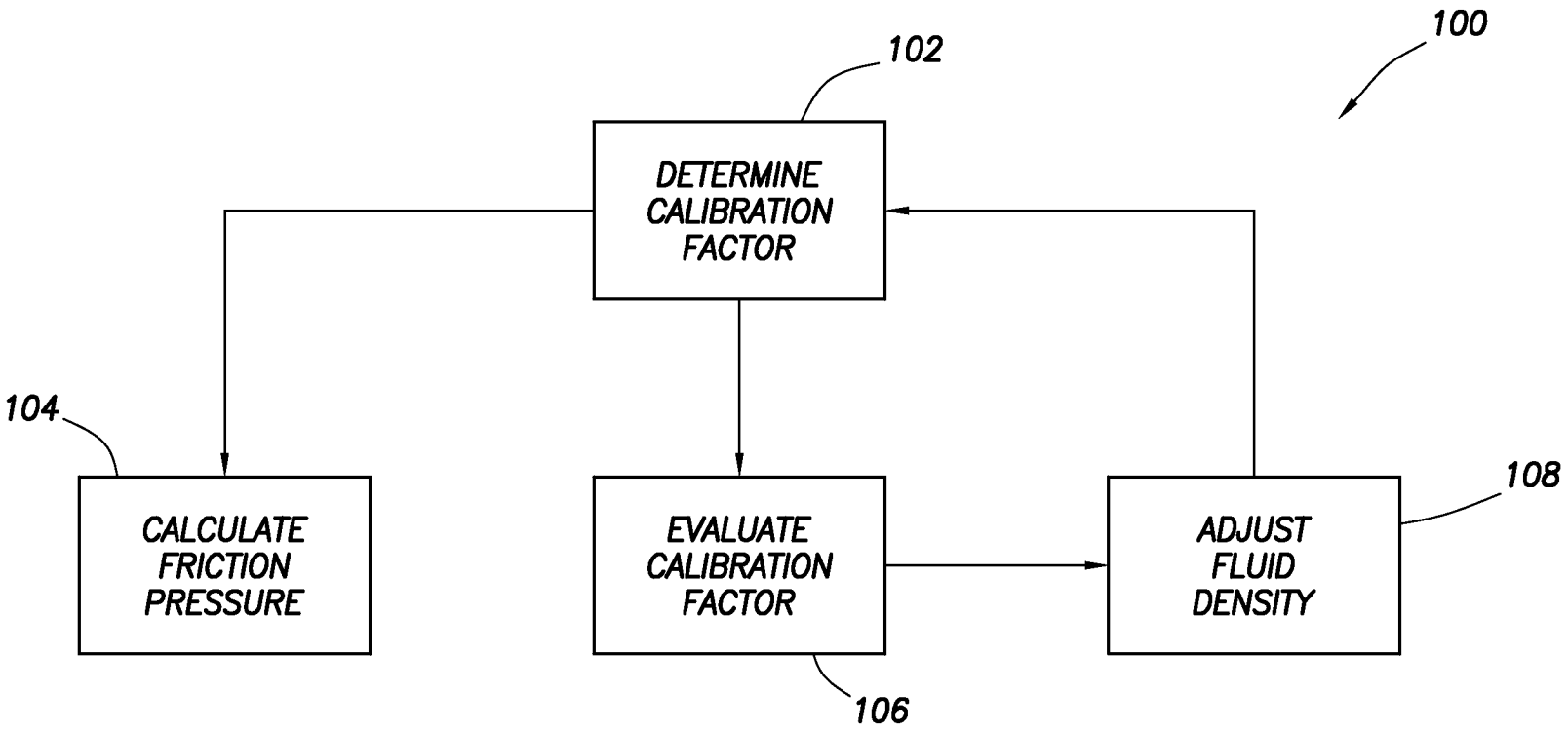
FIG. 5 is a representative flowchart for a method of detecting and mitigating an influx.

Referring additionally now to FIG. 5, an example flowchart for a method 100 of detecting and mitigating an influx into a wellbore 12 during drilling is representatively illustrated. The method 100 may be used with the well drilling system 10 and pressure and flow control system 90 described above, or the method may be used with other systems.

In step 102, the calibration factor CF is determined. Equation 1 may be used to calculate the calibration factor CF, based on measured wellbore 12 pressure (e.g., from sensors 60, such as PWD or MWD tools), measured annulus 20 pressure at or near the surface (WHP), hydrostatic pressure calculated from measured fluid density and true vertical depth, and a friction pressure from the hydraulics model 92. Further description of the calibration factor CF is provided in U.S. Pat. No. 8,240,398, assigned to the assignee of the present application.

The calibration factor CF is used in step 104 to calculate an actual friction pressure. The actual friction pressure (Friction) is used to calculate a desired annulus 20 pressure at or near the surface (WHP) which will result in a desired pressure at a location in the wellbore 12. Equation 2 can be used for this purpose.

In step 106, the calibration factor CF determined in step 102 is evaluated. As discussed above, a relatively high value for the CF is indicative of increased fluid friction in the annulus 20, for example, due to increased drill cuttings, partial wellbore collapse, etc. A rapidly decreasing CF is indicative of an influx into the wellbore. Techniques known to those skilled in the art, such as, trend analysis, a neural network, analysis of slope and/or second order derivatives, etc., may be used in step 106 to identify when an influx or other type of event is occurring, or has occurred.

In step 108, a density of the fluid 18 is adjusted, in order to mitigate the effects of an event indicated in step 106. For example, if an influx is indicated in step 106, then in step 108, the fluid 18 density (e.g., mud weight MW) can be incrementally decreased, so that the calculated Hydrostatic term used in Equation 2 is also decreased. Equation 3 can be used for this purpose. The decrease in fluid 18 density corresponds to a decreased density in the annulus 20 due to the influx, gas expansion, etc.

Note that the actual density of the fluid 18 is not decreased. Instead, the Hydrostatic term used in Equation 2 is incrementally decreased by decreasing the mud weight MW used in calculation of the hydrostatic pressure, so that the applied pressure (WHP in Equation 3) incrementally increases.

This increased applied pressure WHP will eventually prevent further influxes into the wellbore 12, at which point the calibration factor CF will begin to increase and, as a result of repeated application of steps 102, 104 and 108, the fluid density MW used for calculating the Hydrostatic term in Equation 2 will increase. Eventually, the calibration factor CF should level off at approximately one, as conditions return to normal.

It may be desired to limit the increased applied WHP, in order to, for example, prevent damage to a fragile or sensitive formation. In that case, the Hydrostatic term in Equation 2 may only be decreased by a predetermined amount, and/or, a predetermined maximum level may be set for the applied WHP, so that pressure in the wellbore 12 at a certain location will not exceed a maximum level. A limit on the applied WHP may also (or alternatively) be set in order to prevent damage to equipment (such as, surface pressure control and flow equipment).

If the evaluation of the calibration factor CF in step 106 (e.g., by trend analysis, a neural network, analysis of slope and/or second order derivatives, etc.) indicates that a substantial influx has entered the wellbore 12, and well control procedures should begin, the fluid 18 can be automatically diverted to rig well control equipment. For example, in the FIG. 2 schematic, flow of the fluid 18 can be diverted from the choke manifold 32 to a rig choke manifold (e.g., via the Choke Line).

In response to an increase in the calibration factor CF (e.g., indicating increased drill cuttings, partial wellbore collapse, etc.), the Hydrostatic term in Equation 2 could instead be incrementally increased. This will result in less pressure being applied to the wellbore 12 at or near the surface, if desired, for example, to compensate for increased drill cuttings volume in the annulus 20, etc. The Hydrostatic term may be incrementally increased, until the calibration factor CF begins decreasing.

It may now be fully appreciated that the above disclosure provides significant advancements to the art of wellbore pressure control. In one example described above, a calibration factor CF is used to calculate fluid friction pressure in a wellbore 12, and a decrease in the calibration factor indicates that an influx has occurred. A fluid 18 density term can be incrementally changed in response to detecting a predetermined change in the calibration factor CF, in order to, for example, mitigate the effects of an influx.

A well drilling method is provided to the art by the above disclosure. In one example, the method can comprise: drilling a wellbore 12, a fluid 18 circulating through the wellbore 12 during the drilling; determining a calibration factor CF which is applied to a modeled fluid friction pressure; and controlling the drilling based at least in part on a change in the calibration factor CF.

The modeled fluid friction pressure may be generated by a hydraulics model 92.

An increase in the calibration factor CF can indicate an increase in actual fluid friction in the wellbore 12. A decrease in the calibration factor CF can indicate a decrease in hydrostatic pressure in the wellbore.

The method may include setting an alarm when the calibration factor CF decreases below a predetermined level, and/or when the calibration factor CF decreases at greater than a predetermined rate.

The controlling step can include automatically diverting flow of the fluid 18 to a rig choke manifold in response to the change in the calibration factor CF.

The controlling step can include increasing pressure applied to the wellbore 12 at or near the earth's surface, in response to the change in the calibration factor CF. The pressure increasing step may include increasing the pressure applied to the wellbore to a predetermined maximum level.

The controlling step may include incrementally decreasing a Hydrostatic term in the equation: WHP=Desired−Friction−Hydrostatic, where WHP is pressure applied to the wellbore at or near the earth's surface, Desired is a desired pressure at a wellbore location, Friction is fluid friction in the wellbore, and Hydrostatic is hydrostatic pressure at the location.

The incrementally decreasing step can include incrementally decreasing the Hydrostatic term in response to a decrease in the calibration factor CF.

The incrementally decreasing step may include incrementally decreasing the Hydrostatic term, until the calibration factor CF begins increasing, until the WHP term reaches a predetermined maximum level, and/or until the Hydrostatic term has been decreased a predetermined amount.

The controlling step can include, in response to an increase in the calibration factor CF, incrementally increasing a Hydrostatic term in the equation: WHP=Desired−Friction−Hydrostatic, where WHP is pressure applied to the wellbore at or near the earth's surface, Desired is a desired pressure at a wellbore location, Friction is fluid friction in the wellbore, and Hydrostatic is hydrostatic pressure at the location. The Hydrostatic term may be incrementally increased until the calibration factor CF decreases.

A well drilling system 10 is also described above. In one example, the system 10 can comprise a hydraulics model 92 which determines a modeled fluid friction pressure and a calibration factor CF applied to the modeled friction pressure; and a flow control device (such as choke 34) which is automatically controlled in response to a change in the calibration factor CF.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A well drilling method, comprising:

drilling a wellbore and circulating a fluid through the wellbore during drilling;

modeling a fluid friction pressure for the wellbore;

determining a calibration factor which is applied to the modeled fluid friction pressure, wherein the calibration factor is determined based on a measured downhole pressure at a wellbore location, a measured wellhead pressure, a hydrostatic pressure at the we bore location, and the modeled fluid friction pressure; and controlling the drilling based at least in part on a change in the calibration factor, wherein:

an increase in the calibration factor indicates an increase in an actual fluid friction in the wellbore, or a decrease in the calibration factor indicates a decrease in the hydrostatic pressure in the wellbore.

2. The method of claim 1, wherein the modeled fluid friction pressure is generated by a hydraulics model.

3. The method of claim 1, further comprising triggering an alarm when the calibration factor decreases below a predetermined level.

4. The method of claim 1, further comprising triggering an alarm when the calibration factor decreases at greater than a predetermined rate.

5. The method of claim 1, wherein the controlling comprises automatically diverting flow of the fluid to a rig choke manifold in response to the change in the calibration factor.

6. The method of claim 1, wherein the controlling comprises increasing pressure applied to the wellbore at or near the wellbore surface in response to the change in the calibration factor.

7. The method of claim 6, wherein increasing pressure applied to the wellbore at or near the well bore surface comprises increasing the pressure applied to the wellbore until a predetermined level is reached.

8. The method of claim 1, wherein the controlling further comprises incrementally decreasing a Hydrostatic term in the equation:

$$WHP=Desired-Friction-Hydrostatic,$$

where WHP is a pressure applied to the wellbore at or near the earth's surface, Desired is a desired pressure at the wellbore location, Friction is a fluid friction in the wellbore, Hydrostatic is the hydrostatic pressure at the wellbore location, and the Hydrostatic term is the hydrostatic pressure used in determining the calibration factor.

9. The method of claim 8, wherein the incrementally decreasing comprises incrementally decreasing the Hydrostatic term in response to a decrease in the calibration factor.

10. The method of claim 8, wherein the incrementally decreasing comprises incrementally decreasing the Hydrostatic term until the determined calibration factor increases.

11. The method of claim 8, wherein the incrementally decreasing comprises incrementally decreasing the Hydrostatic term until the WHP term reaches a predetermined level.

12. The method of claim 8, wherein the incrementally decreasing comprises incrementally decreasing the Hydrostatic term until the Hydrostatic term has decreased a predetermined amount.

13. The method of claim 1, wherein the controlling comprises, in response to an increase in the calibration factor, incrementally increasing a Hydrostatic term in the equation:

$$WHP=Desired-Friction-Hydrostatic,$$

where WHP is a pressure applied to the wellbore at or near the earth's surface, Desired is a desired pressure at the wellbore location, Friction is a fluid friction in the wellbore, Hydrostatic is the hydrostatic pressure at the wellbore location, and the Hydrostatic term is used in determining the calibration factor.

14. A well drilling system for drilling a wellbore using a fluid, comprising:

a hydraulics model configured to determine a modeled fluid friction pressure and a calibration factor to be applied to the modeled fluid friction pressure, wherein the calibration factor is determined based on a measured downhole pressure at a wellbore location, a measured wellhead pressure, a hydrostatic pressure at the wellbore location, and the modeled fluid friction pressure; and a flow control device configured to be automatically controlled in response to a change in the calibration factor, wherein:

an increase in the calibration factor indicates an increase in an actual fluid friction in the wellbore, or a decrease in the calibration factor indicates a decrease in the hydrostatic pressure in the wellbore.

15. The system of claim 14, wherein an alarm is configured to be triggered when the calibration factor decreases below a predetermined level.

16. The system of claim 14, wherein an alarm is configured to be triggered when the calibration factor decreases at greater than a predetermined rate.

17. The system of claim 14, wherein a flow of the fluid is automatically diverted to a rig choke manifold in response to the change in the calibration factor.

18. The system of claim 14, wherein a pressure applied to a wellbore at or near the earth's surface is increased, in response to the change in the calibration factor.

19. The system of claim 18, wherein the pressure applied to the wellbore at or near the earth's surface is increased to a predetermined level.

20. The system of claim 14, wherein, in response to the change in the calibration factor, a Hydrostatic term is incrementally decreased in the equation:

$$WHP=Desired-Friction-Hydrostatic,$$

where WHP is pressure applied to the wellbore at or near the earth's surface, Desired is a desired pressure at the wellbore location, Friction is an actual fluid friction pressure in the wellbore, Hydrostatic is the hydrostatic pressure at the wellbore location, and the Hydrostatic term is the hydrostatic pressure used in determining the calibration factor.

21. The system of claim 20, wherein the Hydrostatic term is incrementally decreased in response to a decrease in the calibration factor.

22. The system of claim 20, wherein the Hydrostatic term is incrementally decreased so that the WHP is increased until the calibration factor increases.

23. The system of claim 20, wherein the Hydrostatic term is incrementally decreased until the WHP term reaches a predetermined maximum level.

24. The system of claim 20, wherein the Hydrostatic term is incrementally decreased until the Hydrostatic term has been decreased a predetermined amount.

25. The system of claim 14, wherein, in response to the change in the calibration factor, a Hydrostatic term is incrementally increased in the equation:

$$WHP=Desired-Friction-Hydrostatic,$$

where WHP is a pressure applied to the wellbore at or near the earth's surface, Desired is a desired pressure at the wellbore location, Friction is a fluid friction in the wellbore, Hydrostatic is the hydrostatic pressure at the wellbore location, and the Hydrostatic term is used in determining the calibration factor.

26. The system of claim 25, wherein the Hydrostatic term is incrementally increased so that the WHP is decreased until the calibration factor decreases.

27. The method of claim 1, wherein controlling the drilling further comprises controlling a flow control device.

28. A well drilling method, comprising:

drilling a wellbore and circulating a fluid through the wellbore during drilling;

modeling a fluid friction pressure for the wellbore;

determining a calibration factor which is applied to the modeled fluid friction pressure, wherein the calibration factor is determined based on a measured downhole pressure in the wellbore, a measured wellhead pressure, a hydrostatic pressure in the wellbore, and the modeled fluid friction pressure;

controlling the drilling based at least in part on a change in the calibration factor; and triggering an alarm when the calibration factor decreases at greater than a predetermined rate.

* * * * *